US005085148A

United States Patent [19]

Konno

[11] Patent Number: 5,085,148

[45] Date of Patent: Feb. 4, 1992

[54] TOY WITH REMOTE CONTROL TRACK SWITCHING

[75] Inventor: Sunao Konno, Tokyo, Japan

[73] Assignee: Tomy Company, Ltd., Tokyo, Japan

[21] Appl. No.: 524,384

[22] Filed: May 17, 1990

[30] Foreign Application Priority Data

Aug. 24, 1989 [JP] Japan ..... 1-98628[U]

[51] Int. Cl.[5] ..... E01B 23/06

[52] U.S. Cl. ..... 104/130; 104/DIG. 1; 104/295; 238/10 A; 246/415 A

[58] Field of Search ..... 446/467, 433, 454, 456, 446/455, 175; 104/130, 295, 304, 305, DIG. 1; 105/1.5; 246/415 A; 273/86 B, 310; 238/10 A; 434/21, 22; 250/341, 353

[56] References Cited

U.S. PATENT DOCUMENTS

| | | | |
|---|---|---|---|
| 3,190,557 | 6/1965 | Nagy | 246/415 A |
| 4,109,584 | 8/1978 | Mihirogi | 104/130 |
| 4,597,336 | 7/1986 | Forster | 104/130 |
| 4,662,283 | 5/1987 | Chang | 104/130 |
| 4,828,525 | 5/1989 | Okano | 446/175 |
| 4,865,575 | 9/1989 | Rosenthal | 273/312 |
| 4,987,349 | 1/1991 | Nakamura | 446/175 |

FOREIGN PATENT DOCUMENTS

| | | | |
|---|---|---|---|
| 0077723 | 4/1986 | Japan | 250/353 |

*Primary Examiner*—Douglas C. Butler
*Assistant Examiner*—Mark T. Le
*Attorney, Agent, or Firm*—Staas & Halsey

[57] ABSTRACT

A track toy includes an infrared signal transmitter for transmitting at least one type of infrared signal, a track having at least one changeover element movable between two operative positions, and a drive coupled to the at least one changeover element for driving the chageover element between the two operative positions. An infrared signal receiver is associated with each at least one changeover element for receiving the at least one type of infrared signal transmitted by the infrared signal transmission device, and a controller operatively coupled to the infrared signal receiver and the drive, outputs a drive command signal to the drive when the received type of infrared signal matches as predetermined type of infrared signal corresponding to the at least one changeover element.

20 Claims, 7 Drawing Sheets

553a
553
552b
552
550
552a
551
551a
511
511a
510a
520
525
521
512
513
514a
910
29
29a
29c
243
244
29b
242
240
515a
522
540
24a
591
590
580
59
OFF
ON
23
2
27
24b
24c
24
211
212
222
251
252
21(25)
210
221
253
250
200
224
225
220
223
230
229
260
511
510b
5
512
510
513
514b
514
515b

TOY WITH REMOTE CONTROL TRACK SWITCHING

BACKGROUND OF THE INVENTION

1. Field of the Invention:

The present invention relates generally to track toys and, more specifically, to a toy wherein the travelling route of a vehicle, such as a train, passing a branching portion of the track is changed by changeover of an operation point lever.

2. Description of the Related Art:

Heretofore there has been known a track toy which has a branch line and which is played while the travelling route of a vehicle, such as a train, automobile, etc. passing a branch portion of the branch line is changed by changeover of an operation point lever provided in the branch portion.

In the above conventional track toy, the changeover of the operation point lever is performed manually, and this operation is difficult to perform.

It has been proposed to perform such changeover operation by a remote control using a radio controller, but a practical application thereof has been difficult for the following reason.

According to the proposal, the forward and backward movement as well as the travelling speed of a vehicle which travels on a track are controlled by radio control signals using a radio controller. If, in addition to these controls, even the changeover of an operation point lever for changing the travelling route of the vehicle is to be performed by the said radio control, it becomes necessary to increase the number of channels correspondingly. However, under rules established by the Federal Communication Commission, for example, the employable frequency range is limited to an extremely narrow range. Thus, it is difficult to use frequencies properly when the number of channels within the narrow range are increased and there easily occurs interference with a control signal.

For avoiding such interference it has been proposed to use a high-performance radio controller, but this is expensive, and therefore not suitable for track toys which must be provided inexpensively.

SUMMARY OF THE INVENTION

The present invention has been accomplished in view of the above circumstances and it is an object thereof to provide a track toy wherein the changeover of an operation point lever is performed in a simple and positive manner by wire-less, remote control other than by radio signals.

According to the present invention, in order to solve the above-mentioned problem there is provided a track toy having a branch portion and an operation point lever provided in the branch portion, the travelling route of a travelling body or vehicle passing the branch portion being changed by changeover of the operation point lever, the track toy comprising an infrared signal transmitter for transmitting a plurality of different infrared signals; and a track having infrared signal processing means for receiving an infrared signal transmitted from the infrared signal transmitter, converting it into an electrical signal, making discrimination about the electrical signal and generating an operation command signal when it is detected that the electrical signal was based on a specific kind of an infrared signal, drive means operative in accordance with the operation command signal provided from the infrared signal processing means to change over the operation point lever from one to another position, and holding means for holding the operation point lever in the change-over state.

When the travelling route of the vehicle which is travelling on the track is to be changed in a desired branch portion, the corresponding kind of an infrared signal is transmitted by operating the infrared signal transmitter. The infrared signal is received by the infrared signal receiver and then converted to an electrical signal, which is subjected to discrimination. When it is detected that this electrical signal is based on a specific kind of an infrared signal, there is issued an operation command signal from the infrared signal means, and the drive means is operated in accordance with the operation command signal, whereupon the operation point lever in a desired branch portion is changed over from one to another position to change the travelling route of the vehicle. In this way the travelling route of the vehicle is changed over in a simple and positive manner by wireless, remote control and the vehicle is controlled in accordance with an infrared signal issued in the remote control without the interference which may be expected for a radio signal.

DETAILED DESCRIPTION OF THE PREFERRED EMBODIMENTS

Figure 1:
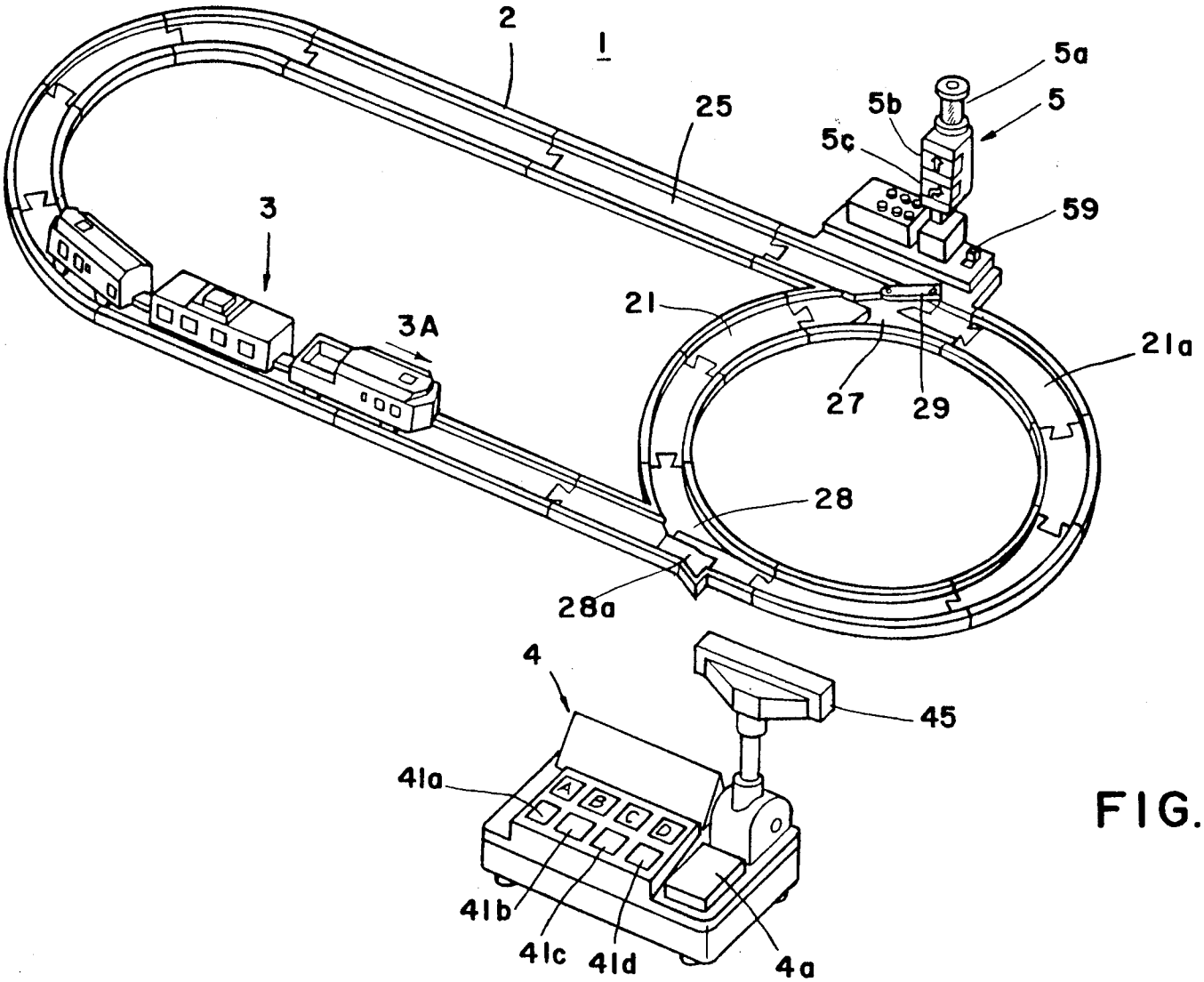
FIG. 1 is an entire perspective view of a track travelling toy embodying the invention.

FIG. 1 is an entire perspective view of a track toy I according to an embodiment of the present invention.

The track toy 1 includes a track 2, a vehicle 3 such as a train for travelling on the track 2, an infrared signal transmitter 4 for transmitting an infrared signal to change the travelling route of the vehicle 3, and an infrared signal receiver 5 for receiving an infrared signal transmitted from the infrared signal transmitter 4 and operating a drive source (not shown in FIG. 1)

when the infrared signal is of a specific kind, to change over an operation point lever 29 in a branch portion 28 of the time from one to another position, thereby changing the travelling route of the vehicle 1.

The track 2 is provided on its upper surface side with a travelling path for the vehicle 3. The travelling path is composed of a first travelling path 21 which is substantially circular and a second travelling path 25 which is oval and has an arcuate end segment common to the first travelling path 21 The operation point lever 29 for changing the travelling route of the vehicle 3 is provided in a first branch portion 27 disposed between the first and second travelling paths 21, 25 so that it is pivotable from one portion to another.

The vehicle 3 is an automatic travelling type adapted to travel while being supplied with electricity from a battery contained in the interior thereof or from the track. It travels automatically while being guided along the first or the second travelling path 21 or 25 on the track 2.

The infrared signal transmitter 4 is provided with an infrared signal generating means (not shown), one or plural signal generating buttons 41*a* to 41*d*, a switch button 4*a* and an infrared signal transmitting portion 45.

On the other hand, the infrared signal receiver 5 is provided with an infrared signal receiving portion 5*a*, direction indicators 5*b*, 5*c* and a switch button 59, and it is disposed on the side of the track 2, preferably having a portion integrally molded on the side of the track.

The track toy 1 of this embodiment is schematically constructed as above and operates as follows.

An explanation will first be made below about the state in which, as shown in FIG. 1, a manual point lever 28*a* in a second branch portion 28 faces in a direction to permit a straight advancement of the vehicle 3, while the operation point lever 29 in the first branch portion 27 faces in a direction to cause the travelling body 3 to move annularly along the circular, first travelling path 21.

If the switch button 59 of the infrared signal receiver 5 is pushed "on" in this state, the lower, direction indicator 5*c* of the receiver 5 which provides a curvilinear arrow indication light, thereby indicating that the vehicle 3 which has reached the first branch portion 27 can curve, while the infrared signal receiving portion 5*a* located at the upper end is capable of receiving an infrared signal.

When the switch button 4*a* of the infrared signal transmitter 4 is pushed, it becomes possible to transmit an infrared signal Alternatively, the switch button 4*a* can be eliminated and each button 41*a* through 41*d* can function as an "on" button for each signal associated with such buttons.

The vehicle 3 is carried onto the travelling path 25 on the track 2 and allowed to travel in the direction of arrow 3A, it passes through the second branch portion 28 and enters a common travelling path of both the first and second travelling paths 21, 25, and then reaches the first branch portion 27.

The travelling body 3 is then guided into the circular direction by the operation point lever 29 in the first branch portion 27, so that it travels along the circular, first travelling path 21. It is understood that the first travelling path need not be circular, nor does the second travelling path have to be oval, but the geometric shape illustrated and described herein are merely exemplary.

Thereafter, unless the operation point lever 29 in the first branch portion 27 is changed over to the other position, the vehicle 3 will continue to travel circularly along the first travelling path 21.

When a player wants to cause the vehicle to travel along the second travelling path 25 during such travelling thereof along the circular, first travelling path 21, the player is required to push the signal generating button 41*a* of the infrared signal transmitter 4 which button is indicated by the mark "A", whereupon there will be issued from the upper, infrared signal transmitting portion 45 an infrared signal of the kind which permits changeover of the operation point lever 29 in the first branch portion 27.

The infrared signal thus issued is received by an infrared signal receiving portion 551 (FIG. 6) of the receiver 5, whereupon the operation point lever 29 in the first branching portion 27 is pivotally changed over to its position which permits a straight advancement of the vehicle 3. At the same time the lower, direction indicator 5*c* of the infrared signal receiver 5 which provides a curvilinear indication is turned OFF, while the upper, direction indicator 5*b* which provides a rectilinear indication is turned ON, thereby indicating that the vehicle 3 which has reached the first branch portion 27 is now capable of moving straight ahead.

Thus, after the operation point lever 29 in the first branch portion 27 had been changed over to a rectilinear state, the vehicle 3 which has reached the first branch portion 27 passes straight ahead through the branch portion 27 and thereafter can travel along the second travelling path 25 which is oval shaped.

Unless the operation point lever 29 in the first branch portion 27 is changed over to the other position, the vehicle 3 will continue to travel along the oval, second travelling path 25.

When the player wants to return the vehicle 3 to the first travelling path 21 during such oval travelling along the second travelling path, the player is required to again push the signal generating button 41*a* indicated by the mark "A" of the infrared signal transmitter 4, whereupon there will be issued from the upper, infrared signal transmitting portion 45 an infrared signal of the kind which permits changeover of the operation point lever 29 in the first branch portion 27. The infrared signal thus issued is received by the infrared signal receiving portion 551 of the receiver 5, whereupon the operation point lever 29 in the first branch path 27 is again changed over to the original curvilinear state. At the same time, the upper, direction indicator 5*b* of the infrared signal receiver 5 which provides a rectilinear indication is turned OFF, while the lower, direction indicator 5*c* which provides a curvilinear indication is turned ON thereby indicating that the vehicle 3 which has reached the first branch portion 27 is now capable of moving straight ahead.

Thus, by changing over the operation point lever 29 in the first branch portion 27 the vehicle 3 is returned to circular travelling along the circular, first travelling path 21.

Thus, at every depression of the signal generating button 41*a* indicated by the mark "A" of the infrared signal transmitter 4 the operation point lever 29 in the first branching portion 27 is changed over alternately between its curvilinear state and rectilinear state, and at every such changeover the vehicle 3 is changed alternately between the state in which it can travel along the annular, first travelling path 21 and the state in which it can travel along the oval, second travelling path 25.

In the track 2 shown in FIG. 1, the branch portion 27 in which the operation point lever 29 is changed over from one state to the other in accordance with an infrared signal is provided, only one is illustrated. However, four kinds of infrared signals can be produced by depression of the signal generating buttons 41*a*–41*d* indicated by the marks "A" to "D" of the infrared signal transmitter 4, so by using those four kinds of signals properly it becomes possible to not only provide four branch portions but also provide an operation point lever in each of those branch portions and change over those operation point levers each individually.

Figure 2:
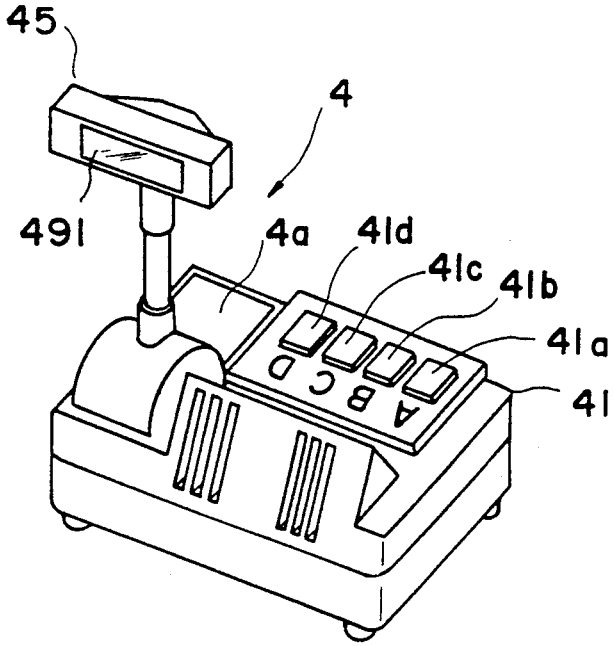
FIG. 2 an entire perspective view of an infrared signal transmitter of the FIG. 1 embodiment.

FIG. 2 is an enlarged, perspective view of the infrared signal transmitter 4 as seen from the opposite side.

As shown in the same figure, the infrared signal transmitter 4 is provided with a body 41 and a transmitting portion 45 upstanding from the body 41.

On the upper side of the body 41 there are provided the marks "A" to "D" and signal generating buttons 41*a* to 41*d* capable of being depressed in positions corresponding to those marks respectively. Inside the body 41 there is disposed a later-described infrared signal generating means (not shown).

The infrared signal transmitter 4 is constructed schematically as above in appearance. Upon depression of any of the signal generating buttons 41*a*–41*d* corresponding to the marks "A" -"D", the corresponding infrared signal out of the four different kinds of infrared signals is transmitted from a transmitting window 491.

Figure 3:
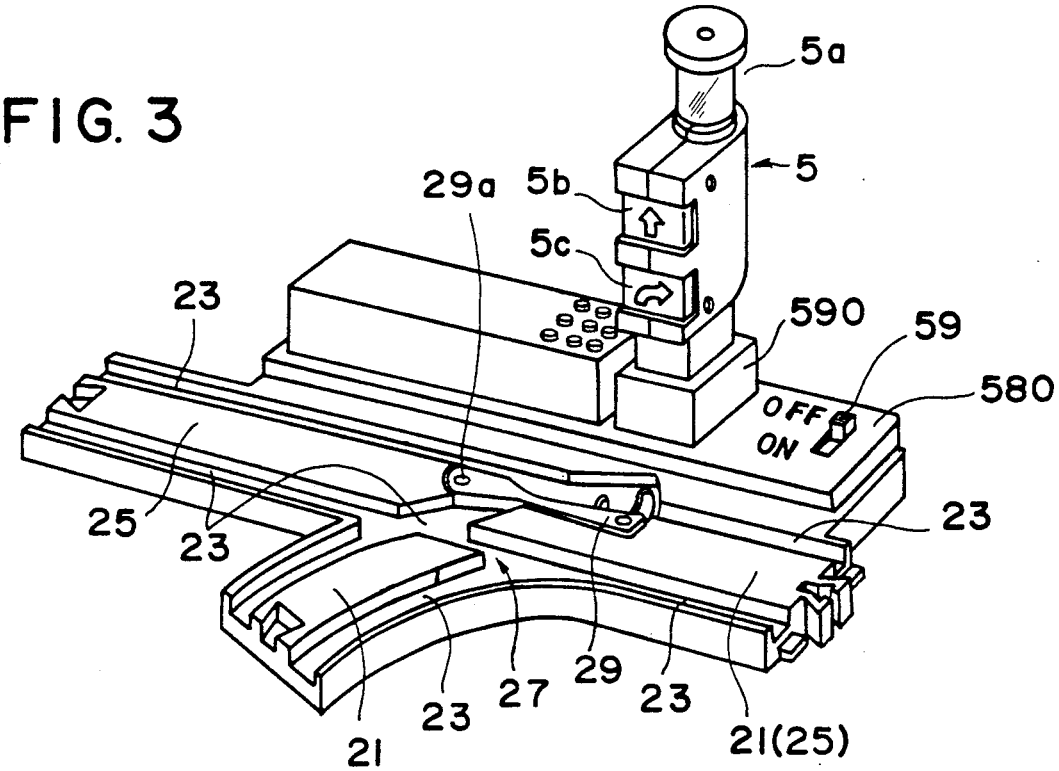
FIG. 3 a perspective view of a first branch portion of a track and an infrared signal receiver mounted therein.

FIG. 3 is a perspective view of the first branch portion 27 of the track 2 and the infrared signal receiver 5 adjacent an outside to the branch portion 27.

As shown in FIG. 3, the branch portion 27 is provided with wheel guide slots 23 in a branched relation to each other so that the wheels of the vehicle 3 travelling leftwards from the right side can be guided in the straight direction or the curved direction. In the outside wheel guide slot 23 in the branch portion 27 there is mounted the operation point lever 29 so that the lever can be changed over from one to the other position pivotally about a pin 29*a*.

On the other hand, the infrared signal receiver 5 is provided with an infrared signal receiving portion 5*a*, direction indicators 5*b*, 5*c* and a switch button 59. On the surface of the upper indicator 5*b* there is indicated a rectilinear arrow, while on the surface of the lower indicator 5*c* there is indicated a curvilinear arrow.

The first branch portion 27 of the track 2 and the infrared signal receiver 5 adjacent outside to the branch portion 27 are schematically constructed as above in appearance. With the switch button 59 ON, an infrared signal transmitted from the infrared signal transmitter 4 is received by the infrared signal receiving portion 5*a* located at the upper end. Then, whether the infrared signal thus received is of a specific kind or not is judged by infrared signal control means (not shown) capable of receiving and discriminating the signal, and if it is judged to be a specific infrared signal, a later-described drive means (not shown) mounted in the interior of the branch portion 27 is operated in accordance with a signal provided from the infrared signal control means, whereby the pivotal changeover of the operation point lever in the branch portion 27 is performed. Further, depending on which of the rectilinear state and the curvilinear state the operation point lever 29 was changed over, the corresponding direction indicator 5*b* (or 5*c*) goes ON.

Figure 4:
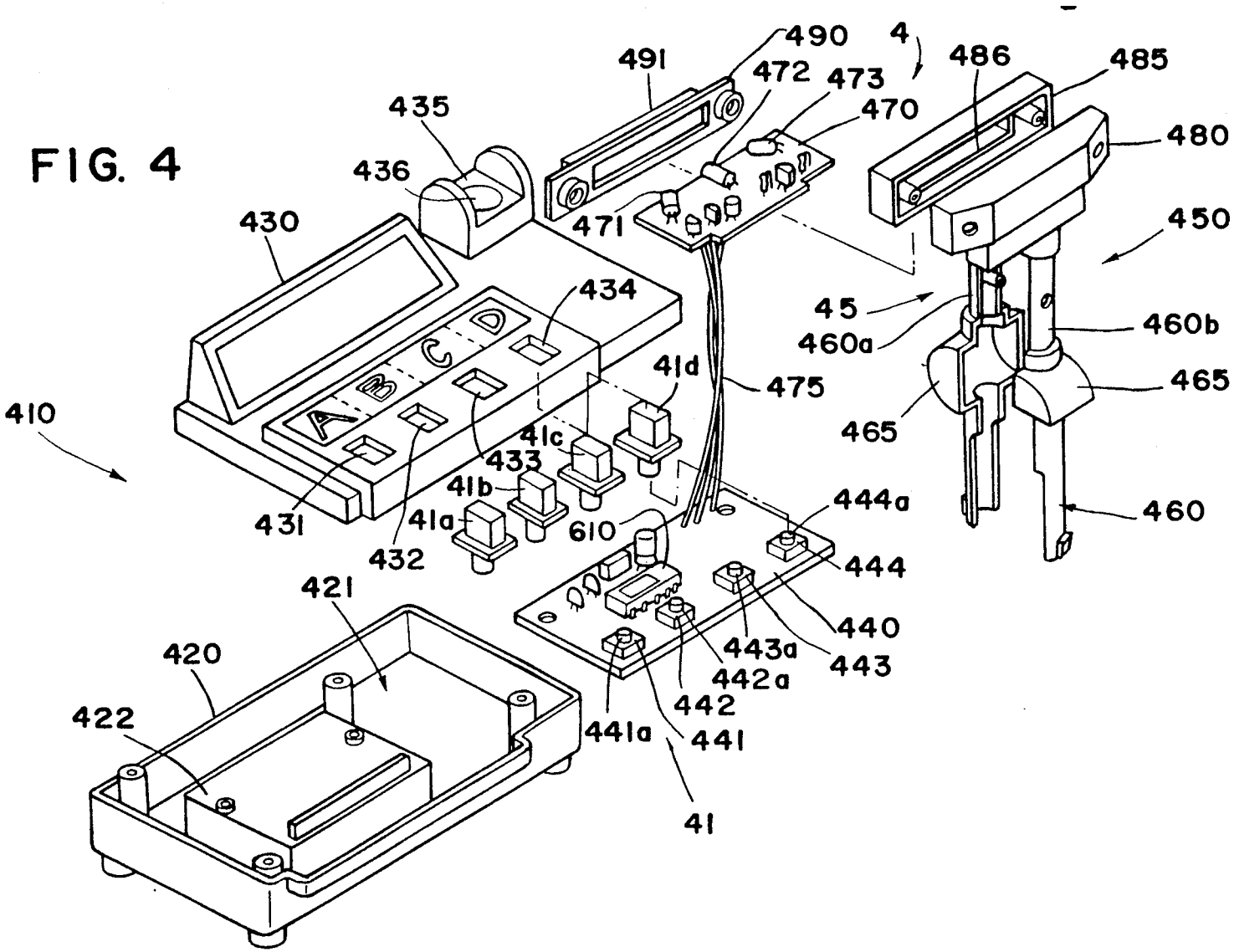
FIG. 4 is an exploded perspective view of the infrared signal transmitter according to the present invention.

FIG. 4 is an exploded perspective view of the infrared signal transmitter 4.

The infrared signal transmitter 4, as shown in the same figure, is provided with a body frame 410 which constitutes an outer shell of the body 41, a signal generation control board 440 disposed inside the body frame 410, a transmitting frame 450 which constitutes an outer shell of the transmitting portion 45 erected on the body frame 410, and a light emitting board 470 disposed in an interior space of the upper end of the transmitting frame 450.

The body frame 410 is composed of a base portion 420 and a cover portion 430.

The base portion 420 is in the form of a box having an open top. In its interior space 421 there is disposed a board mount 422, on which is mounted the signal generation control board 440. The board may alternatively be mounted to the cover portion, if desirable.

On the signal generation control board 440 there is mounted an integrated circuit or microcomputer 610 which constitutes a later-described signal generation control circuit 600 (FIG. 10) as well as various electronic parts, and there are also mounted operating button mounts 441 through 444 having depression type switches 441*a* through 444 having depression type switches 441*a* through 444*a*respectively at the central portions of the upper ends of the corresponding mounts. Signal generating buttons 41*a* to 41*d* for depressing the depression type switches 441*a*–444*a* have recessed or hollow open lower-end portions (not shown) into which the switches 441*a*–444A are fitted for operative contact with an actuation by the corresponding buttons On the other hand, the cover portion 430 is formed in the shape of a box having an open bottom. On the outer surface there are provided the marks "A" through "D", and through holes 431 through 434 disposed next to those marks respectively. At the upper right hand corner of the cover portion 430 there is provided a transmitting frame mount 435. In the center of the mount 435 there is formed a mounting hole 436 in the shape of a cylindrical, vertically disposed through hole.

The cover portion 430 thus constructed is mounted to cover the upper opening 421 of the base portion 420 with the signal generation control board 440 mounted thereon. In this mounted state, the signal generating buttons 41*a*–41*d* are projecting depressably above the cover portion 430 through the through 431–434 of the cover portion.

The transmitting frame 450 is provided with axially split halves 460*a* and 460*b*, assembled to form a cylindrical pillar portion 460 and a board mounting portion 480 having an interior in communication with the upper end of the hollow pillar portion 460 and having a front opening. In middle positions of the cylindrical pillar portion halve 460*a* and 460*b* there are provided enlarged resting portions 465.

The light emitting board 470 referred to previously is received within the board mounting portion 480.

On the light emitting board 470 there are mounted infrared light emitting diodes (LEDs) 471 through 473 which constitute an infrared light emitting circuit 700, as well as various electronic parts.

A window member 490 having a light transmitting window 491 is mounted to the front opening of the board mounting portion 480 with the light emitting board 470 received therein so as to cover the said opening. Further, to the front side of the board mounting frame 480 there is mounted a cover frame 485 to cover the window member 490. In this mounted state, the window 491 of the window member 490 is fitted in an opening 486 formed centrally in the front wall portion of the cover frame 485 so that its front face is substantially flush therewith.

The lower end of the cylindrical pillar portion 460 of the infrared signal transmitting portion 45 thus constructed is rotatably fitted in a central mounting hole 436 of the transmitting frame mount 435 of the cover portion 430. The enlarged portions 465 provided in middle portions of the cylindrical pillar halves 460*a* and 460*b* rest on the transmitting frame mount 435.

Lead wires 475 extend through the cylindrical pillar 460. The signal generation control board 440 mounted within the body portion 410 and the light emitting board 470 mounted within the board mounting portion 480 at the upper end of the transmitting frame 450 are electrically connected with each other through the lead wires 475.

Figure 5:
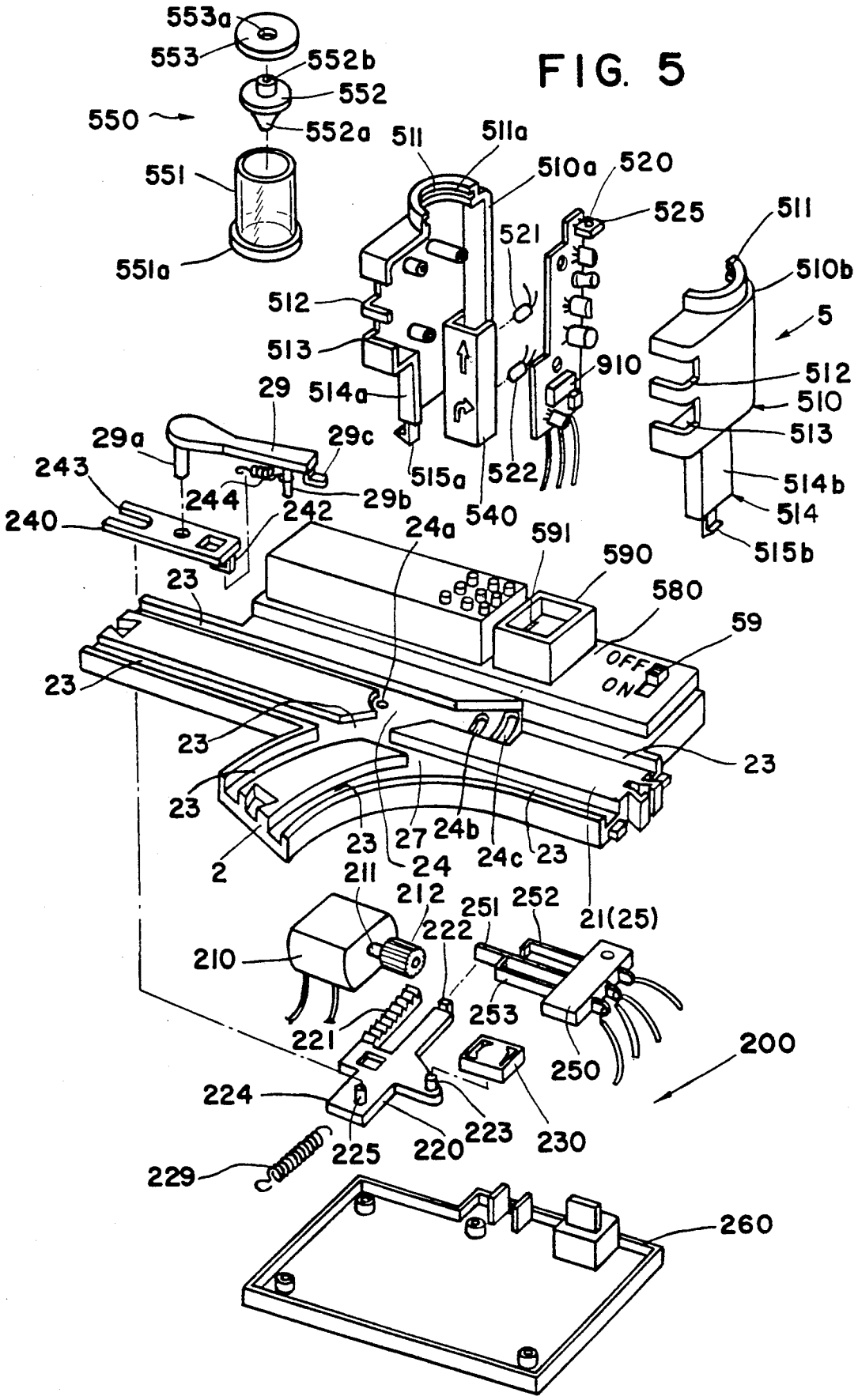
FIG. 5 is an exploded perspective view of the first branch portion of the track, the infrared signal receiver mounted therein and a drive means mounted on the underside of the first branch portion.

FIG. 5 is a exploded perspective view of both the infrared signal receiver 5 mounted by the side of the first branch portion 27 of the track 2 and drive means 200 for actuating the operation point lever 29 mounted in the lower interior of the first branch portion 27.

As shown in FIG. 5, an operation point lever mounting slot 24 which permits the pivotal changeover of the operation point lever 29 is formed in the outside wheel guide slot 23 in the first branch portion 27.

On the side which serves as a base side of the mounting slot 24 there is formed a shaft hole 24*a*, while on the opposite side there are formed first and second arcuate openings 24*b*, 24*c*.

On the other hand, a pivot shaft 29*a* is provided on the underside of the base portion of the operation point lever 29, while on the opposite side an actuating pin 29*b* and a guide piece 29*c* are provided on the underside.

The pivot shaft 29*a* of the operation point lever 29 is inserted into the shaft hole 24*a* formed in the mounting slot 24, while the actuating pin 29*b* and the guide piece 29*c* are inserted into the first and second arcuate openings 24*b*, 24*c*, respectively, whereby the operation point lever 29 is mounted in the slot 24 so that it can be changed over from one position to the other about the pivot shaft 29*a*.

The outer shell of the infrared signal receiver 5 is constituted by right and left axial split halves 510*a* and 510*b* forming a hollow container 510 when assembled.

In the upper ends of the halves 510*a* and 510*b* there is formed an opening formed by semi-circular portion openings 511 for mounting an infrared signal receiver. An infrared signal receiver 550 as the infrared signal receiving portion 5*a* is mounted in the opening.

The receiver 550 is provided with a cylindrically shaped receiver window 551 mounted in the opening 511, a conically shaped converging mirror 552 received in the upper portion of the receiver window 551, and a cap 553 which is mounted to close an upper-end opening of the receiver window 551 while holding the converging mirror 552.

The receiver window 551 is formed using a light transmitting material and its lower end is formed as a flange portion 551*a*.

The flange portion 551*a* is fitted in annular grooves 511*a* formed in the upper ends of the container halves 510*a* and 510*b* which define the mounting opening, and is held thereby, whereby the receiver window 511 is upstanding from the opening.

The converging mirror 552 is provided on the lower side thereof with a mirror or reflecting surface 552 a for reflecting downwards and converging all of lights which it received from its surroundings, and is also provided centrally of its upper end with a cylindrical mounting lug 552*b*.

The converging mirror 552 is received in the upper end portion of the receiver window 551 and its upper end lug 552*b* is fitted in a central circular hole 553*a* of the cap 553, and then fixed with a screw 552*c*, whereby the converging mirror 552 is rendered integral with the cap 553. Thus, in a supported state by the cap 553 the converging mirror 552 is received in the upper-end opening of the receiver window 551.

Within the container 510 there is mounted an infrared signal reception control board 520. On the control board 520 there are mounted a later-described infrared signal receiving/discriminating/control circuit 800 (FIG. 11), a microcomputer or integrated circuit (IC) 910 which constitutes a drive control circuit 900 (FIG. 11), and other electronic parts. Also, a photodiode which constitutes the infrared signal receiving/discriminating/control circuit 800 is mounted in a position in which an infrared signal is converged by the converging mirror 552. Further, first and second direction indicating lamps 521 and 522 are mounted on the control board 520.

In the front wall on the upper portion of the container 510 there are formed first and second indication windows 512, 513 in positions corresponding to the height positions of the first and second direction indicating lamps 521, 522, respectively. Inside the indication windows 512 and 513 there is disposed an indication lens or window frame 540 formed of a light transmitting material. On the upper portion of the outer surface of the indication window frame 540 there is an arrow indication indicating a straight advance, while on the lower portion thereof there is an arrow indication indicating a curved advance. The straight-advance and curved-advance indicating arrows are positioned in the first and second indication windows 512, 513, respectively.

On the lower side of each container 510 there is formed a mounting portion 514 having an external form which is generally square pillar-like, and formed by half segments 514*a* and 514*b* integrally molded with corresponding container halves 510*a* and 510*b*. The lower end of each mounting portion half 514*a* and 514*b* is fitted in a socket 590 formed on a mounting portion 580 disposed on the outside of the first branch portion 27 of the track 2, whereby the infrared signal receiver 5 is erected on the mounting portion 580. In this erected state, retaining arms 515*a* and 515*b* provided at the lower ends of the mounting portion halves 514*a* and 514*b* are snap-fitted into and engaged with engaging holes 591 formed in the lower portion of the socket 590, whereby the container 510 is retained in a vertical upright position.

Figure 6:
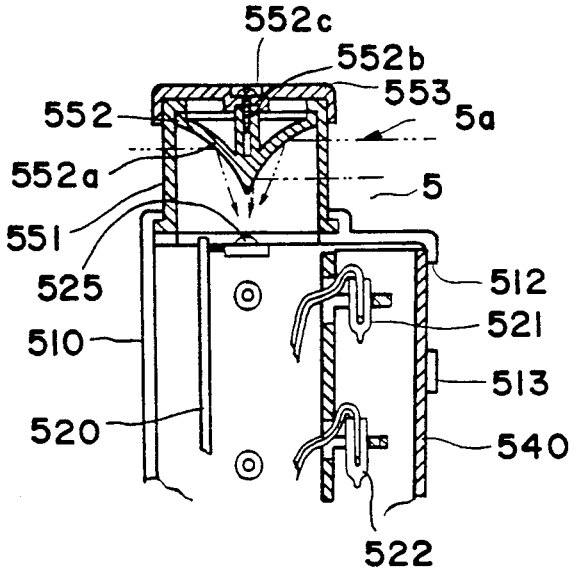
FIG. 6 a side view partially in vertical section of the infrared signal receiver.

In the infrared signal receiver 5 having the above construction, as shown in FIG. 6, even when light passes through the receiver window 551 from any direction, the light is reflected by the mirror surface 552*a* of the converging mirror 552 located in the interior and is converged in the direction of the photodiode 525 on the infrared signal reception control board 520 which is disposed centrally of the upper portion of the infrared signal receiver 5.

On the other hand, the drive means 200 disposed in the interior of the lower portion of the first branch portion 27 of the track 2 is provided with a motor 210 as a drive source, an actuating member 220 and holding 230 for holding the actuating member 220 selectively in returned an shifted positions, an actuating lever 240 for pivotally moving the operation point lever 29 by converting the moving force of the actuating member 220 into a rotating force, and a changeover switch 250 which is changed over from on to another position with shift and return of the actuating member 220.

Figure 7:
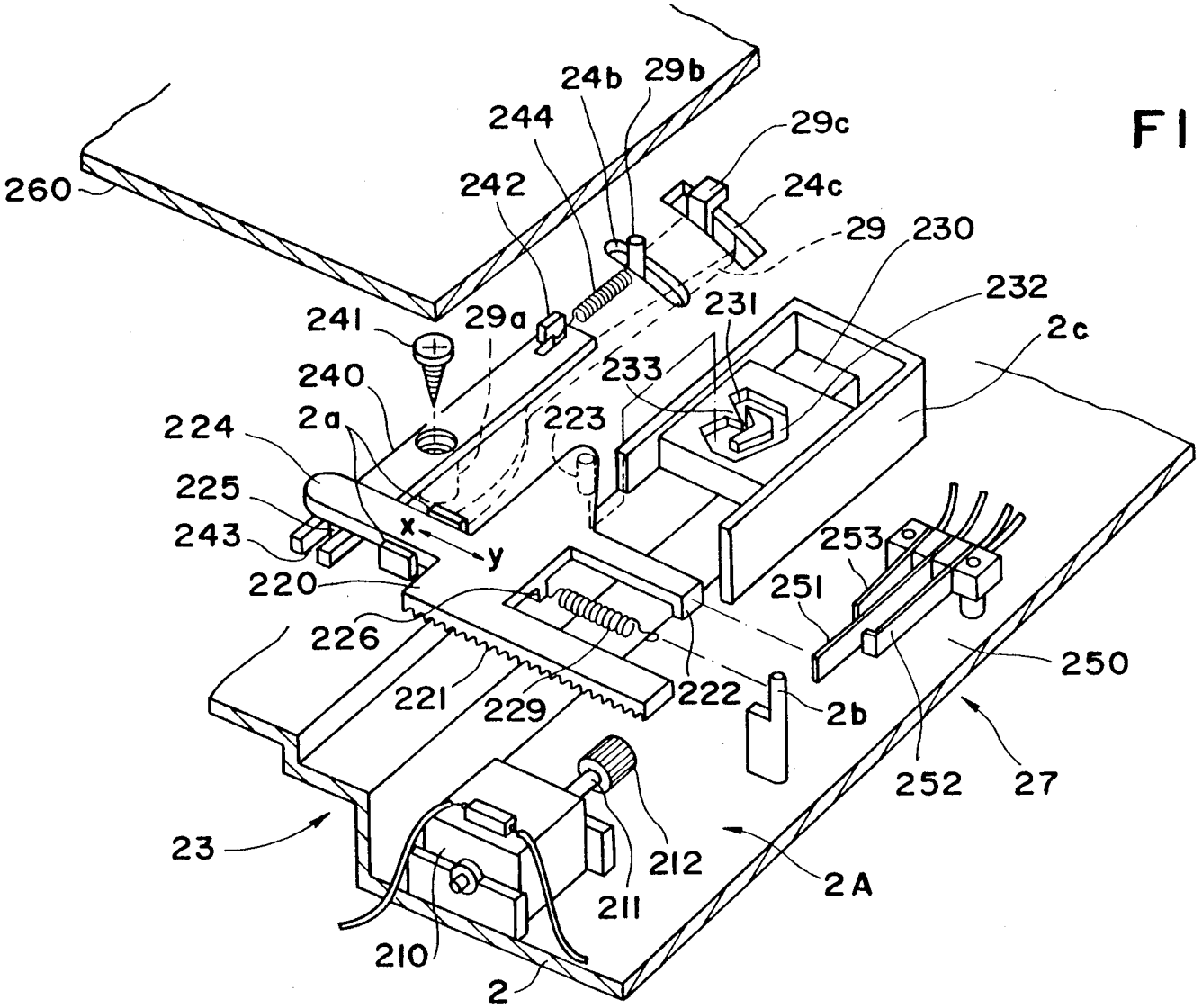
FIG. 7 an exploded perspective view of the drive means on the underside of the first branch portion as seen upside down.

The motor 210, as shown upside down in FIG. 7, is mounted on an upper wall portion in an interior space 2A on the lower (back) side of the first branch portion 27 of the track 2. A pinion gear 212 is mounted on an output drive shaft 211 of the motor.

The actuating member 220 is provided with a rack 221 which meshes with the pinion gear 221 at all times, a hook-like changeover piece 22 for changeover of the changeover switch 250, a first engaging pin 223 for engagement with the holding member 230, a movable guide arm 224, and a second engaging pin 225 for engagement with the actuating lever 240.

By means of a pair of guide pieces 2*a*, 2*a* projecting from the lower (back) side of the first branch portion 27 the movable guide arm 224 is slidably supported in a direction perpendicular to the operation point lever 29 provided in the first branch portion, and it is given a returning force in a direction away from the operation point lever 29 by means of a coil spring 229 stretched between the actuating member 220 and a support pin 2*b* projecting from the upper wall portion on the lower (back) side of the first branch portion 27.

The holding member 230 is guided for sliding movement in a direction perpendicular to the moving direction of the actuating member 220 by means of a movement guide frame 2*c* provided on the underside of the first branch portion 27.

In the lower surface of the holding-member 230 there is formed a cam groove 231 in the shape of a loop to hold the actuating member 220 selectively in the returned position by the coil spring 229 and the shifted position in the direction of the operation point lever 29 by the motor 210. The first actuating pin 223 of the actuating member 220 is received in the cam groove 231 and acts as a cam to cooperate with the cam groove to hold the print lever in either of its two operative positions.

At every reciprocating motion of the actuating member 220 made by the action of the motor 210 and that of the coil spring 229 the first actuating pin 223 of the actuating member is held in an alternate manner in first and second holding portions 232, 233 formed in the cam groove 231, as will be explained later in detail, whereby the actuating member 220 is changed in position between its returned position in the arrow Y direction and its shifted direction in the arrow X direction. On the lower (back) side of the first branch portion 27 the actuating lever 240 is pivotally mounted with a screw 241 coaxially with the pivot shaft 29*a* of the operation point lever 29 which is mounted pivotably on the upper (surface) side of the first branch portion. Although having a common pivot axis, the actuating lever 240 actuates independently of the lever 29.

A coil spring 244 is stretched between a hook piece 242 formed at one end of the actuating lever 240 and the actuating pin 29*b* of the operation point lever 29 which has reached the lower (back) side of the first branch portion 27 through the first arcuate opening 24*b*, whereby the operation point lever 29 is pivoted due to the interconnection with the actuating lever 240 through the spring 244.

On the other hand, an engaging slot 243 is formed in the other end of the actuating lever 240, and a second pin 225 of the actuating member 220 extends into the slot 243, whereby the actuating lever 240 is pivoted about a sliding pivot axis in conjunction with the shift and return operations of the actuating member 220, so that the operation point lever 29 is changed over pivotally between the position for curved advance of the travelling body 3 and the position for straight advance thereof.

Juxtaposed in front of the changeover piece 222 of the actuating member 220 there is mounted a changeover switch 250 for changing over ON and OFF states alternately between the first and second indicating lamps 521, 522.

The changeover switch 250 is provided with a central changeover contact 251 capable of flexing elastically and first and second contacts 252 and 253 disposed on both sides of the central changeover contact 251 and capable of being turned ON and OFF alternately with elastic deformation of the changeover contact 251. It should be understood that contacts 252 and 253 are also capable of flexing.

As will be described later in detail, as the actuating member 220 moves, the changeover piece 251 comes into contact with the central changeover contact 251 to deform the latter elastically, whereby the first and second contacts 252, 253 are turned ON and OFF in an alternate manner, so that the first and second indicating lamps 521, 522 are lit alternately. As an example, when the actuating member 220 moves in the "X" direction such that the operation point lever 29 is pivoted into the shifted position (angled) to permit access the circular track portion 21, the changeover piece 282 moves away from and out of abutment with changeover piece 251, in which case contact 251 is in electrical contact with contact 253 but not 252. In this position, the spring 229 is stretched to create a return bias, but since pin 223 is held against the V-shaped holding portion 233 of the cam, the shifted position is held. Then, when the motor 210 is driven again, the actuating member 220 moves in the "X" direction causing pin 223 to slide the holding means 230 to shift to the left into a non-holding position so that the spring 229 returns the operative point lever 29 to the return (straight) position. When the actuating member 220 is thus returned, changeover piece 222 abuts contact 251 and pushes it out electrical contact with contact 253 and into electrical contact with contact 252.

Figure 8:
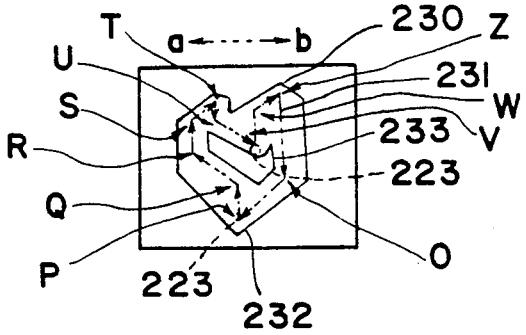
FIG. 8 is a bottom view of a holding means.

FIG. 8 is a view in which the holding member 230 is seen from the underside thereof, showing a position holding action of the cam groove 231 for the actuating member 220.

When the actuating member 220 is in a completely returned state in the arrow Y direction in FIG. 7 by the coil spring 229, its first actuating pin 223 is held by the first holding portion 232 in the cam groove 231, whereby the actuating member 220 is held in that returned state.

If in this state the motor 210 is operated and the actuating member 220 is thereby moved in the arrow X direction in FIG. 7, the first actuating pin 223 of the actuating member 220 moves through the cam groove 231 and reaches the position "T", following the route of "P", "Q", "R", "S", "T".

The actuating member 220 cannot move laterally in the directions of arrows "b" and "a" in FIG. 8 upon contact of its first actuating pin 223 with side walls of the cam groove 231 and the holding means 230 cannot move axially in the directions of arrows "X" and "Y". Thus, the holding means 230 slides in the A/B directions in response to the actuating member 220 moving in the X/Y direction, whereby the above "P, Q, R, S, T" movement is made possible.

Then, upon turning OFF of the motor 210 after the movement up to the position "T", the actuating member 220 is moved in the arrow Y direction (returning direction) by virtue of the coil spring 229. Thus, the motor is only required to operate in one direction, and for only a brief period of time to effect the required movement.

With this movement, the actuating pin 223 of the actuating member 230 moves through the cam groove 231 up to the position "V", following the route of "T", "U", "V".

This movement is made possible by the sliding movement of the holding member 230 in the arrow "a" direction in FIG. 8 upon contact of the first actuating pin 223 of the actuating member 220 with side walls of the cam groove 231.

When the first actuating pin 223 has moved to the position "V", it is held by the second holding portion 233 in that position, whereby the actuating member 220 is held in the X shifted state in FIG. 7.

Next, when in this state the motor 210 is operated and the actuating member 220 is thereby moved in X direction in FIG. 7, the first actuating pin 223 of the actuating member moves through the cam groove 231 and reaches the position "Z", following the route of "V", "W", "Z".

This movement is made possible by the sliding movement of the holding means 230 in the arrow a direction in FIG. 8 upon contact of the first actuating pin 223 with side walls of the cam groove 231.

Upon turning OFF of the motor 210 after the movement up to the position "Z", the actuating member 230 is moved in the arrow Y direction (returning direction) in FIG. 7 by virtue of the coil spring 229.

With this movement, the actuating pin 223 of the actuating member 230 moves through the cam groove 231 shown in FIG. 8 and returns to the initial position "P", following the route of "Z", "0", "P".

This movement is made possible by the sliding movement of the holding means 230 in the arrow b direction in FIG. 8 upon contact of its first actuating pin 223 with side walls of the cam groove 231.

When in this way the first actuating pin 223 has returned to the initial position "P" in the cam groove 231, it is again held by the first holding portion 232 in that position, whereby the actuating member 220 is held in its returned state.

Thus, every time the actuating member 220 is returned in the Y direction (returning direction) by virtue of the coil spring 229 after being moved in the arrow X direction in FIG. 7 by the motor 210, the first actuating pin 223 moves to and is held by the first and second holding portions 232, 233 in the cam groove 231 in an alternate manner, whereby the actuating member 220 is changed over alternately to the returned position in the Y direction in FIG. 7 and the shifted position in the X direction.

Figure 9:
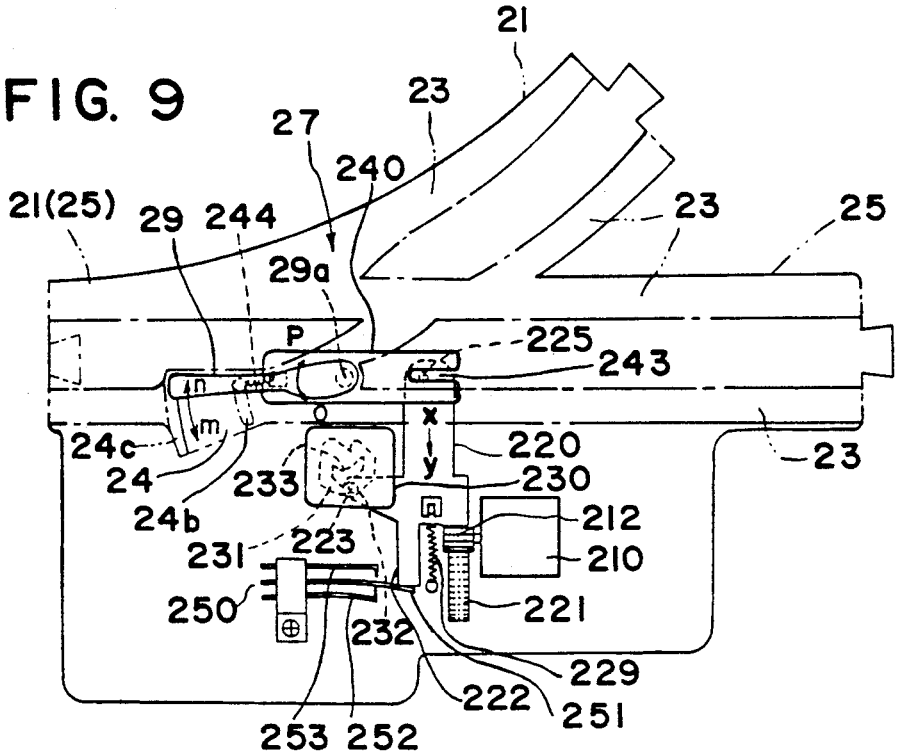
FIG. 9 is a plan view of the first branch portion, showing a changeover mechanism of an operation point lever mounted in the first branch portion.

FIG. 9 illustrates a changeover mechanism of the operation point lever 29 mounted in the first branch portion 27, as a plan view of the first branch portion 27.

In connection with this changeover mechanism, an explanation will first be made about an initial state in which the actuating member 220 is returned in the arrow Y direction in FIG. 9 by the coil spring 229. In this state, the first actuating pin 223 is held by the first holding portion 232 in the cam groove 231 of the holding member 230, and the actuating lever 240 and the operation point lever 29 are pivotally returned in the P and n directions, respectively, about the pivot shaft **29*a*. Further, the tip of the changeover piece 222 of the actuating member 220 is in abutment with the tip of the changeover contact 251 of the changeover switch 250, thereby causing the changeover contact 251 to be flexed and come into contact with the first contact 252, so that the first direction indicating lamp 521** for providing a rectilinear direction indication is ON.

If in this state the motor 210 is operated and the actuating member 220 is moved in the X direction thereby and is thereafter moved in the Y direction (returning direction) by the coil spring 229, the first actuating pin 223 comes to be held by the second holding portion 233 in the cam groove 231 of the holding member 230.

As a result, the actuating lever 240 is pivoted in the arrow O direction about the pivot shaft **29*a* by the action of the second actuating pin 225 of the actuating member 220, so that the operation point lever 29 is pivoted in the arrow m direction about the pivot shaft 225. At the same time, the tip of the changeover piece 222 of the actuating member 220 moves out of contact with the changeover contact 251 reverts to its contacted state with the second contact 253 by its elastic restoring force, thereby turning ON the second direction indicating lamp 522** which provides a curvilinear direction indication.

If in this state the motor 210 again operates and the actuating member 220 is thereby moved in the X direction and thereafter is returned in the Y direction (returning direction) by the coil spring 229, the first actuating pin 223 is returned to its initial state in which it is held by the first holding portion 232 in the cam groove 231 of the holding member 230. At the same time, the operation point lever 29 returns in the 0 direction about the pivot shaft **29*a* to its initial state in which the first direction indicating lamp 521** for providing a rectilinear direction indication turns ON.

Thus, every time the actuating member 220 is moved in the Y direction (returning direction) after being moved in the X direction by the operation of the motor 210, the held position of the first actuating pin 223 is changed alternately to the first and second holding portions 232, 233 of the cam groove 231, so that the operation point lever 29 is changed over in an alternate manner between the state in which it is in a rectilinear state and the first direction indicating lamp 521 for providing a rectilinear indication is ON and the state in which it is in a curvilinear state and the second direction indicating lamp 522 for providing a curvilinear indication is ON.

Figure 10:
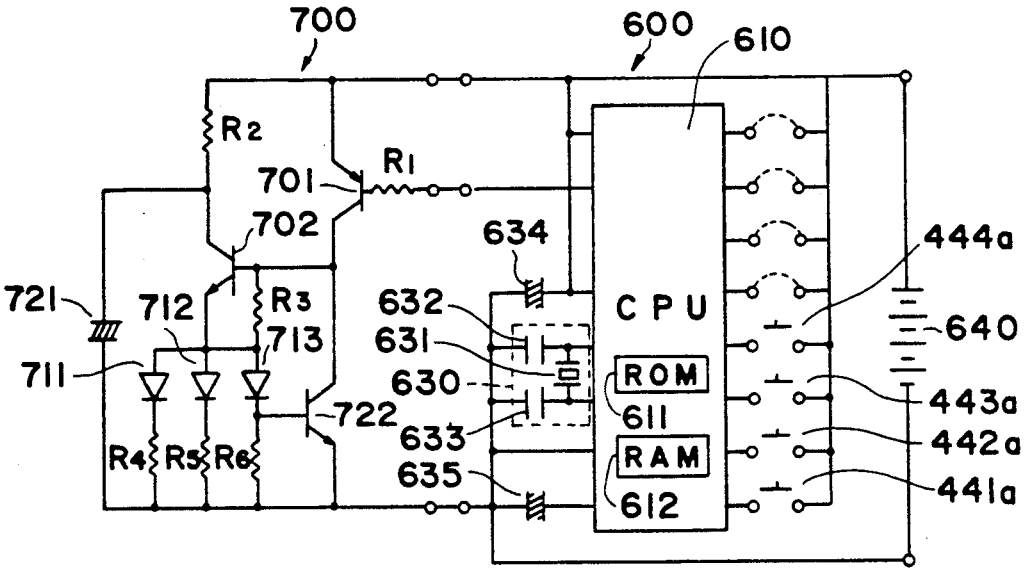
FIG. 10 is a view showing a signal generation control circuit and a light emitting circuit of the infrared signal transmitter.

FIG. 10 shows an example of the signal generation control circuit 600 disposed on the signal generation control board 440 of the infrared signal transmitter 4 and an example of the light emitting circuit 700 disposed on the light emitting board 470.

In the same figure, the component indicated by the reference numeral 610 is a control chip microcomputer.

The microcomputer 610 is provided with a read only memory (ROM) (fixed data storage means), and a random access memory (RAM) 612 (variable data storage means) capable of reading and writing.

In the ROM 611 there are stored as fixed data four kinds of infrared signal pattern data (e.g. four kinds of pattern data different in the number of times of flashing per unit time), while in the RAM 612 there are stored various signals such as switch signals in a temporary manner.

To the microcomputer 610 there are connected switches 441*a* to 444*a* which are depressed by the signal generating buttons 41*a*–41*d*; a main clock generating circuit 630 composed of an oscillator 631 and capacitors 6322, 633; by-pass capacitors 634, 635 and a power source 640.

On the other hand, the infrared light emitting circuit 700 is provided with first and second transistors 701, 702 which constitute an amplifier circuit for amplifying an output signal provided from the microcomputer 610; infrared light emitting diodes 711 to 713 which go on and off in accordance with the signal amplified by the transistors 701 and 702; a power stabilizing capacitor 721; and a protective transistor 722 for cutting off a electric current exceeding a rated current.

In the signal generation control circuit 600 and infrared light emitting circuit 700 thus constructed, when any of the four switches 441*a*–444*a* is operated, the corresponding signal out of the four kinds of signal patterns stored in the ROM 611 is outputted from an output terminal of the microcomputer 610.

This output signal is amplified by the first and second transistors 701, 702 and the amplified signal is fed to the infrared light emitting diodes 711, 712, 713, which in turn go on and off and generate an infrared signal corresponding to that signal.

Thus, four kinds of infrared signals (e.g. each capable of distinguishing the kind on the basis of the number of times of flashing per unit time or the lighting time) can be generated from the infrared light emitting diodes 711, 712, 713 according to which switch (551*a*–444*a*) is turned ON.

The voltage applied to the transistor 702 and the infrared light emitting diodes 711, 712, 713 is stabilized by the power stabilizing capacitor 721 and a control is made by the transistor 722 to prevent an electric current above the rated current from being applied to the diodes 711, 712, 713.

In the circuit shown in FIG. 10, the marks $R_1$ to $R_6$ represent resistors. The resistor values do not form a part of the present invention and can be chosen in accordance with the values of the other components, all of which are commercially available.

Figure 11:
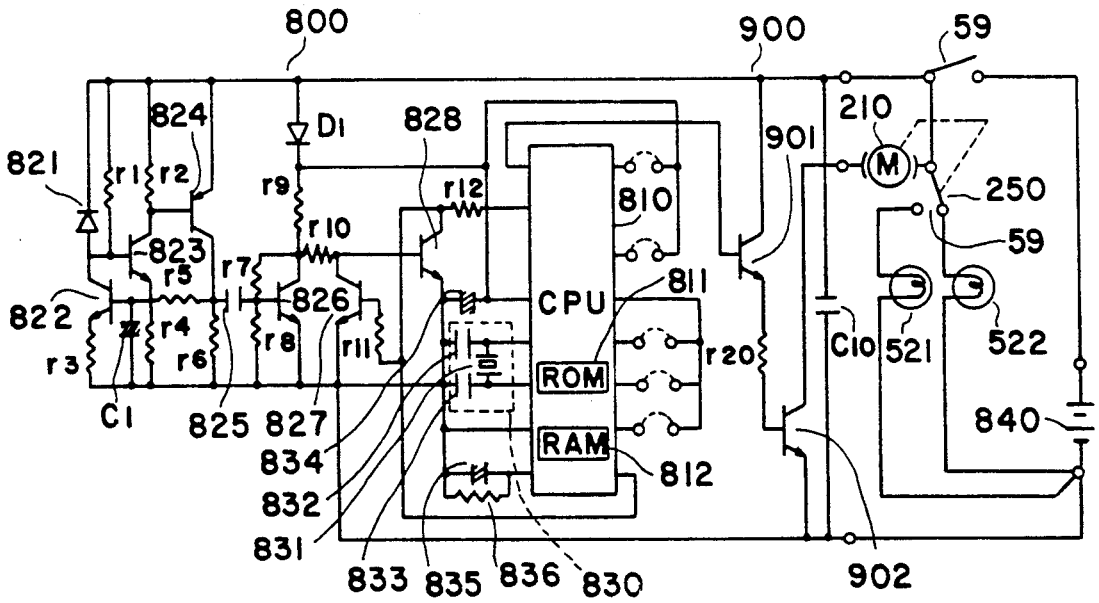
FIG. 11 is a view showing an infrared signal reception control circuit and a drive control circuit of the infrared signal receiver

FIG. 11 shows an example of the infrared signal reception control circuit 800 and the drive control circuit 900 both disposed on the infrared signal control board 520 of the infrared signal receiver 5.

In the same figure, the component indicated by the reference numeral 810 is a control chip microcomputer which constitutes the infrared signal control circuit (section) 800.

The microcomputer 810 is provided with an ROM 811 (fixed data storage means) which is a read only memory and an RAM 812 (variable data storage means) which permits reading and writing.

In this embodiment, fixed data for the discrimination of infrared signals are stored in the ROM 811, while in the RAM 812 there are temporarily stored signals fed from the exterior.

To the microcomputer 810 there are connected a main clock generating circuit 830 composed of an oscillator 831 and capacitors 832, 833; by-pass capacitors 834, 835; a by-pass resistor 836 and a power source 840.

The infrared signal reception control circuit 800 is provided with, in addition to the microcomputer 810, a photodiode 821 for receiving the infrared signal; a bias setting transistor 822; first and second transistors 823, 824 which constitute an amplifier circuit for amplifying a signal transmitted from the photodiode 821; a capacitor 825 which cuts off the thus-amplified DC signal; and third to fourth transistors 826–828 which constitute a latch circuit for latching an AC signal fed through the capacitor 825.

In the infrared signal control circuit 800 thus constructed, when the infrared signal is received by the photodiode 821, it is amplified by the amplifier circuit composed of the first and second transistors 823, 824, then its DC portion is cut by the capacitor 825 and the resulting AC signal enters the latch circuit composed of the third to fifth transistors 826–828, in which it is latched as a signal of H level. In this state the signal is fed to an input terminal of the microcomputer 810.

Thereafter, a reset signal is provided from the microcomputer 810 to the collector of the fifth transistor 828 to unlatch the H level signal.

Then, when an infrared signal is again received by the photodiode 821, it passes through the amplifier circuit composed of the first and second transistors 823, 824 and then through the capacitor 825, then as an amplified AC signal, the signal enters the latch circuit composed of the third to fifth transistors 826–828 in which it is latched as a signal of H level. And in this state the signal 1 fed to the input terminal of the microcomputer 810.

Thus, every time an infrared signal is received by the photodiode 821, it is latched as a signal of H level by the latch circuit, which signal is then fed to the microcomputer 810.

This input signal is subjected to discrimination by the microcomputer 810, and when it is detected that the signal is a specific kind of a signal, an operation command signal is outputted over a predetermined period of time from an output terminal of the microcomputer 810 in accordance with that result of the discrimination.

In this circuit, the reference marks $r_1$ to $r_{12}$ represent resistors, $C_1$ a capacitor, and $D_1$ a diode.

The drive circuit 900 is provided with a driver composed of seventh and eighth transistors 901, 902 which are connected to an output terminal of the microcomputer 810; the motor 210 which is operated by the said driver to change over the operation point lever 29 from one to the other position; the changeover switch 250 which is actuated by the actuating member 220 moved by the motor 210; the first and second direction indicating lamps 521, 522 which are turned ON in an alternate manner by the operation of the changeover switch 250; and the power source 840.

In the drive circuit 900 thus constructed, when an operation command signal is issued for a predetermined time from the microcomputer 810, it is fed to the driver composed of the transistors 901 and 902, which in turn operates the motor 210.

By the shifting force created by the operation of the motor 210 and the returning force induced by the coil spring 244 the actuating member 220 changed alternately to its shifted position and returned position referred to previously, so that the changeover switch 250 is operated in an alternate manner, whereby the second and first direction indicating lamps 522, 521 are turned on and off alternately.

In this circuit, the reference marks $r_{20}$ and $c_{10}$ denote a resistor and a capacitor, respectively.

Since the track travelling toy of this embodiment is constructed as above, when any one of the signal generating buttons 41*a*–41*d* of the infrared signal transmitter 4 is depressed, an infrared signal of the kind corresponding thereto (the kind capable of being detected according to the number of times of flashing per unit time or the lighting time) is transmitted and received by the infrared signal receiver 5. Whether the infrared signal thus received is of a specific kind or not is judged by the receiver 5, and if the answer is affirmative, an operation command signal is issued from the receiver 5 to operate the motor 210, whereby the operation point lever 29 is changed over from one to the other position.

Thus, the changeover of the operation point lever 29 can be effected using an infrared signal, so even when the travelling body 3 travelling on the track 2 is driven by a radio controller, the changeover of the operation point lever 29 can be done by infrared signals in a simple and accurate manner without interference with the driving radio signals.

Although in the above embodiment there is provided only one branch portion wherein the changeover of the operation point lever 29 can be performed using an infrared signal, since a plurality of kinds of infrared signals are capable of being transmitted from the infrared signal transmitter, such as four in the illustrated embodiment, there may be provided plural branch portions in each of which the changeover of the operation point lever is performed using an infrared signal, and four kinds of infrared signal receivers separately which permit discrimination of infrared signals corresponding to the kinds capable of being transmitted from the infrared signal transmitter 4 and which permit changeover of the operation point levers in the branching portions. With the infrared signal transmitter 4, the operation point levers in the four branching portions can be operated separately by such arrangement.

The operation of like point levers in a larger number of branch portions can be done by increasing the number of channels of infrared signals capable of transmitting from the infrared signal transmitter 4.

Although in the above embodiment the infrared signal receiver 5 is mounted upright by the side of the track 2 in an appearance shape capable of being distinguished from the other portions, it may be formed integrally with the track 2 in an appearance shape incapable of being distinguished from the track.

Further, although in the above embodiment there is shown only an example in which the travelling route of the travelling body 3 on the track is changed by changing over the operation point lever in the branching portion from one to the other position in accordance with an infrared signal, this does not constitute any limitation. There may be provided a mechanism which permits rising and falling of a part of the track, as well as various other mechanisms, and these mechanisms may be operated using infrared signals.

According to the present invention, as set forth hereinabove, there is provided a track travelling toy having a branch portion and an operation point lever disposed in the branch portion, the travelling route of a vehicle passing the branch portion being changed by the changeover of the operation point lever, the said track travelling toy comprising an infrared signal transmitter for transmitting plural kinds of infrared signals; and a track having an infrared signal receiving/discriminating/control means for receiving an infrared signal transmitted from the infrared signal transmitter, converting it into an electrical signal and generating an operation command signal when it detected that the electrical signal was based on a specific kind of an infrared signal, a drive means adapted to operate in accordance with the operation command signal provided from the infrared signal receiving/discriminating/control means to change over the operation point lever from to another position and a holding means for holding the operation point lever in the changed-over state. Under this construction, when the travelling route of the travelling body on the track is to be changed in a desired branch portion, the infrared signal transmitter is operated to transmit the corresponding kind of an infrared signal, then the infrared signal thus transmitted is received by the infrared signal receiver and converted into an electrical signal. The electrical signal is subjected to discrimination and the drive means is operated in accordance with an operation command signal provided from the infrared signal receiving/discriminating/control means when it is detected that the electrical signal is based on a specific kind of an infrared signal By the operation of the drive means the point lever in the desired branch portion is actuated to change the travelling route of the travelling body. Thus, the travelling route of the vehicle can be changed in a simple and exact manner by remote control. Even when the vehicle is controlled by a radio wave signal in radio remote control, there will never occur interference with that radio wave signal. Besides, the track travelling toy of the present invention is inexpensive.

What is claimed is:

1. A track toy comprising:

infrared signal transmission means for transmitting at least one type of infrared signal;

a track having at least one changeover element movable between two operative positions;

drive means coupled to the at least one changeover element for driving the changeover element between the two operative positions;

infrared signal receiver means associated with each at least one changeover element for receiving the at least one type of infrared signal transmitted by the infrared signal transmission means;

control means operatively coupled to the infrared signal receiver means and the drive means, for outputting a drive command signal to the drive means when the received type of infrared signal matches a predetermined type of infrared signal corresponding to the at least one changeover element;

wherein the track includes a plurality of changeover elements and the infrared signal transmission means transmits plural types of infrared signals, each type of signal corresponding to one of the plural changeover element, and the control means associated with each infrared signal receiver means includes discrimination means for comparing the plurality of transmitted signals to the predetermined types of infrared signals, each type of signal corresponding to one of the plural changeover elements, and to control means associated with each infrared signal receiver means and outputting the corresponding drive command when the predetermined and transmitted infrared signals match;

wherein the drive means includes an electric drive motor operatively coupled to each changeover element;

wherein each changeover element includes a pivotal lever movable between the two operative positions on an upper surface of a segment of track; and wherein each changeover element further includes an actuating arm disposed on a lower surface of the track segment and having a common pivot axis with the pivotal lever, the pivotal lever being elastically connected to actuating arm by a resilient member.

2. A track toy according to claim 1, further comprising means for holding the at least one changeover element in one of the two operative positions.

3. A track toy according to claim 1, wherein the resilient member is a spring.

4. A track toy according to claim 1, wherein the drive means includes a sliding member operatively disposed between each drive motor and the pivotal lever and being driven in a first direction when each corresponding drive motor is energized to thereby move the corresponding pivotal lever to one of the two operative positions.

5. A track toy according to claim 4, wherein each command signal drives each drive motor for a predetermined duration

6. A track toy according to claim 5, further comprising a return bias mechanism for biasing each sliding member towards a return position corresponding to the other of the two operative positions.

7. A track toy according to claim 6, further comprising means, operatively coupled to each sliding member, for holding the sliding member in the one operative position, thereby preventing return movement to the other operative position imparted by the return bias mechanism.

8. A track toy according to claim 7, wherein the return bias mechanism is a spring coupled to the sliding member and being placed in tension when the sliding member moves to the one operative position.

9. A track toy according to claim 2, wherein the holding means comprises a cam having a holding surface and being operatively connected to the drive means for movement between two holding positions.

10. A track toy according to claim 7, wherein the holding means comprises a cam having a holding surface and being operatively connected to the drive means for movement between two holding positions.

11. A track toy according to claim 10, wherein the cam is slidable in a direction perpendicular to a direction of sliding movement of the sliding member.

12. A track toy according to claim 1, further comprising indicator means associated with each at least one changeover element for indicating either by the two opposite positions.

13. A track toy according to claim 12, wherein the indicator means comprises first and second lights, each corresponding to one of the two operative positions, and switch means associated with each at least one changeover element for switching to either of the first and second lights in response to the operative position of the changeover element.

14. A track toy according to claim 13, wherein the switch means is actuated by the drive means.

15. A track toy according to claim 4, further comprising indicator means associated with each of the plurality of changeover elements for indicating either of the two operative positions of each changeover element.

16. A track toy according to claim 15, wherein each indicator means comprises first and second lights, each corresponding to one of the two operative positions, and switch means associated with each of the plurality of changeover elements for switching in either of the first and second lights in response to the operative position of the corresponding changeover elements.

17. A track toy according to claim 1, wherein the infrared signal receiving means includes a photodiode and a clock generating circuit for converting a transmitted infrared signal to an electrical signal, and the control means includes discrimination means for comparing the electrical signal to a predetermined value stored in memory of control means.

18. A track toy according to claim 1, wherein the infrared signal transmission means includes at least one light emitting diode and a clock generator circuit for generating plural types of pulsed output signals fed to the at least one light emitting diode to emit corresponding plural types of infrared signals.

19. A track toy according to claim 17, wherein the infrared signal receiver means includes a collector operatively coupled to the photodiode for collecting infrared signals.

20. A track toy according to claim 19, wherein the collector is a cone-shaped reflector disposed in an inverted position over the photodiode.

* * * * *